US009244420B2

(12) United States Patent
Yanagi

(10) Patent No.: US 9,244,420 B2
(45) Date of Patent: Jan. 26, 2016

(54) IMAGE FORMING APPARATUS AND METHOD FOR CONTROLLING RECORDING MEDIUM CONVEYANCE

(71) Applicant: CANON KABUSHIKI KAISHA, Tokyo (JP)

(72) Inventor: Yuya Yanagi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/098,405

(22) Filed: Dec. 5, 2013

(65) Prior Publication Data

US 2014/0093297 A1 Apr. 3, 2014

Related U.S. Application Data

(63) Continuation of application No. 12/469,902, filed on May 21, 2009, now Pat. No. 8,682,239.

(30) Foreign Application Priority Data

May 27, 2008 (JP) ..... 2008-138251

(51) Int. Cl.
*G03G 15/00* (2006.01)

(52) U.S. Cl.
CPC .. *G03G 15/6564* (2013.01); *G03G 2215/00945* (2013.01); *G03G 2215/0196* (2013.01)

(58) Field of Classification Search
CPC ..... G03G 15/6558; G03G 15/657; G03G 2215/00409
USPC ..... 399/66, 308, 388, 396
See application file for complete search history.

(56) References Cited

U.S. PATENT DOCUMENTS

| | | | | |
|---|---|---|---|---|
| 5,227,854 | A | 7/1993 | Dastin | |
| 6,009,298 | A | 12/1999 | Sakamaki | |
| 6,301,452 | B1 | 10/2001 | Yoshizawa | |
| 6,564,025 | B2 * | 5/2003 | Sameshima et al. | 399/68 |
| 2004/0156653 | A1 | 8/2004 | Takehara | |

FOREIGN PATENT DOCUMENTS

| | | | |
|---|---|---|---|
| CN | 1713086 | A | 12/2005 |
| JP | H07-140740 | A | 6/1995 |
| JP | 2006-349837 | A | 12/2006 |
| JP | 2007-147758 | A | 6/2007 |
| JP | 2007-249098 | A | 9/2007 |
| JP | 2008-026785 | A | 2/2008 |

* cited by examiner

*Primary Examiner* — Benjamin Schmitt
(74) *Attorney, Agent, or Firm* — Canon USA, Inc. IP Division

(57) ABSTRACT

An image forming apparatus has an intermediate transfer member to which an image on an image bearing member is primarily transferred. The image primarily transferred to the intermediate transfer member is secondarily transferred to a recording medium. The velocity at which the recording medium is conveyed is switched to a velocity different from the image forming velocity before the recording medium is conveyed to the transfer position.

14 Claims, 5 Drawing Sheets

IMAGE FORMING APPARATUS AND METHOD FOR CONTROLLING RECORDING MEDIUM CONVEYANCE

CROSS REFERENCE TO RELATED APPLICATIONS

The present application is a continuation of U.S. patent application Ser. No. 12/469,902, filed on May 21, 2009, which claims priority from Japanese Patent Application No. 2008-138251, filed May 27, 2008, all of which are hereby incorporated by reference herein in their entirety.

BACKGROUND OF THE INVENTION

1. Field of the Invention

The present invention relates to an image forming apparatus that forms an image on a recording medium using an image bearing member such as an intermediate transfer member, and a method for controlling recording medium conveyance in an image forming apparatus.

2. Description of the Related Art

In recent years, image forming apparatuses such as laser printers and copying machines are required to form images at high speed to achieve high throughput, to form high-quality images, to have multiple functions, and to be able to form images on various types of recording media (hereinafter referred to as sheets).

For example, in color laser printers, a method is employed in which an intermediate transfer member capable of bearing a plurality of developer images is used. This method can increase the number of images formed per unit time, and is suitable for improving image quality when forming color images. In this method, a developer image is formed using developer (for example, toner) on a photosensitive drum serving as an image bearing member, the developer image is primarily transferred to an intermediate transfer member, and then the developer image is secondarily transferred from the intermediate transfer member to a sheet.

In the case of such a configuration, the intermediate transfer member and a secondary transfer member for transferring the developer image from the intermediate transfer member to the sheet are pressed against each other at a predetermined pressure and form a pressure contact portion (hereinafter referred to as nip). When the sheet enters the nip, load variation can occur in the intermediate transfer member.

Particularly when a sheet of heavy paper enters the nip at high velocity, the load variation is significant. This load variation can cause deformation of drive transmission members, such as gears, and significant velocity variation in the intermediate transfer member. If significant velocity variation occurs in the intermediate transfer member when the developer image on the photosensitive drum is transferred (primarily transferred) to the intermediate transfer member, density variation occurs in the developer image and results in a defective image. To prevent such a defect image from being formed, the velocity variation of the intermediate transfer member needs to be minimized.

To minimize the velocity variation due to the load variation, the material of gears can be changed to a high-rigidity one that is difficult to deform. However, in general, if the rigidity of gears is increased, defect image formation from other causes, such as banding, is likely to occur. In general, a material having a rigidity without negative effect such as banding cannot sufficiently curb the velocity variation. It is difficult to select the optimum material without negative effect.

Japanese Patent Laid-Open No. 11-52743 discloses a configuration in which a secondary transfer member that transfers a developer image from an intermediate transfer member to a sheet, is rockably supported, and the secondary transfer member is rocked when the sheet enters the nip between the intermediate transfer member and the secondary transfer member. Due to this configuration, the load variation of the intermediate transfer member can be curbed, and the velocity variation can be reduced. Japanese Patent Laid-Open No. 2007-147758 discloses an art in which, when the leading edge of a sheet enters the nip, the sheet is accelerated at a predetermined rate so as to curb the velocity variation of the intermediate transfer member.

However, in the case of the art disclosed in Japanese Patent Laid-Open No. 11-52743, since the secondary transfer member rocks when the sheet enters the nip, the efficiency of transferring the developer image to the sheet decreases, and defect image formation can occur. In addition, since mechanism elements for rocking the secondary transfer member are added, increase in cost is inevitable. Alternatively, the load variation of the intermediate transfer member when the sheet enters the nip can be reduced by reducing the pressure in the nip between the intermediate transfer member and the secondary transfer member. However, also in this case, defective image formation due to decrease in transfer efficiency becomes a problem.

In the case of the art disclosed in Japanese Patent Laid-Open No. 2007-147758, since the sheet enters the nip in the middle of changing the speed of the motor, the load variation of the intermediate transfer member due to the entry of the sheet destabilizes the rotation of the motor, and a step-out of the motor can occur.

SUMMARY OF THE INVENTION

In an aspect of the present invention, an image forming apparatus includes an image bearing member, an intermediate transfer member to which an image formed on the image bearing member is transferred, a secondary transfer member configured to transfer the image that was transferred on the intermediate transfer member to a recording medium, a conveying unit configured to convey the recording medium to a transfer portion formed by the intermediate transfer member and the secondary transfer member, and a control unit configured to control the speed at which the recording medium is conveyed by the conveying unit. The control unit is configured to convey the recording medium to the transfer portion at a first speed, higher than a speed at which the intermediate transfer member is moved, before the recording medium reaches the intermediate transfer member, and to convey the recording medium at the first speed for a predetermined time after the recording medium reaches the transfer portion.

In another aspect of the present invention, a method is for controlling conveyance of a recording medium in an image forming apparatus, the apparatus having an intermediate transfer member to which an image on an image bearing member is transferred, the image transferred to the intermediate transfer member subsequently being transferred to a recording medium by a secondary transfer member. The method includes the steps of conveying the recording medium at a first speed, higher than a speed at which the intermediate transfer member is moved, to a transfer portion formed by the intermediate transfer member and the secondary transfer member, and conveying the recording medium at the first speed for a predetermined time after the recording medium reaches the transfer portion.

Further features of the present invention will become apparent from the following description of exemplary embodiments with reference to the attached drawings.

DESCRIPTION OF THE EMBODIMENTS

The basic configuration of an image forming apparatus according to embodiments of the present invention will now be described in detail with reference to the drawings. The following embodiments are illustrative only, and the technical scope of this invention is not intended to be limited thereto.

First Embodiment

Figure 1:
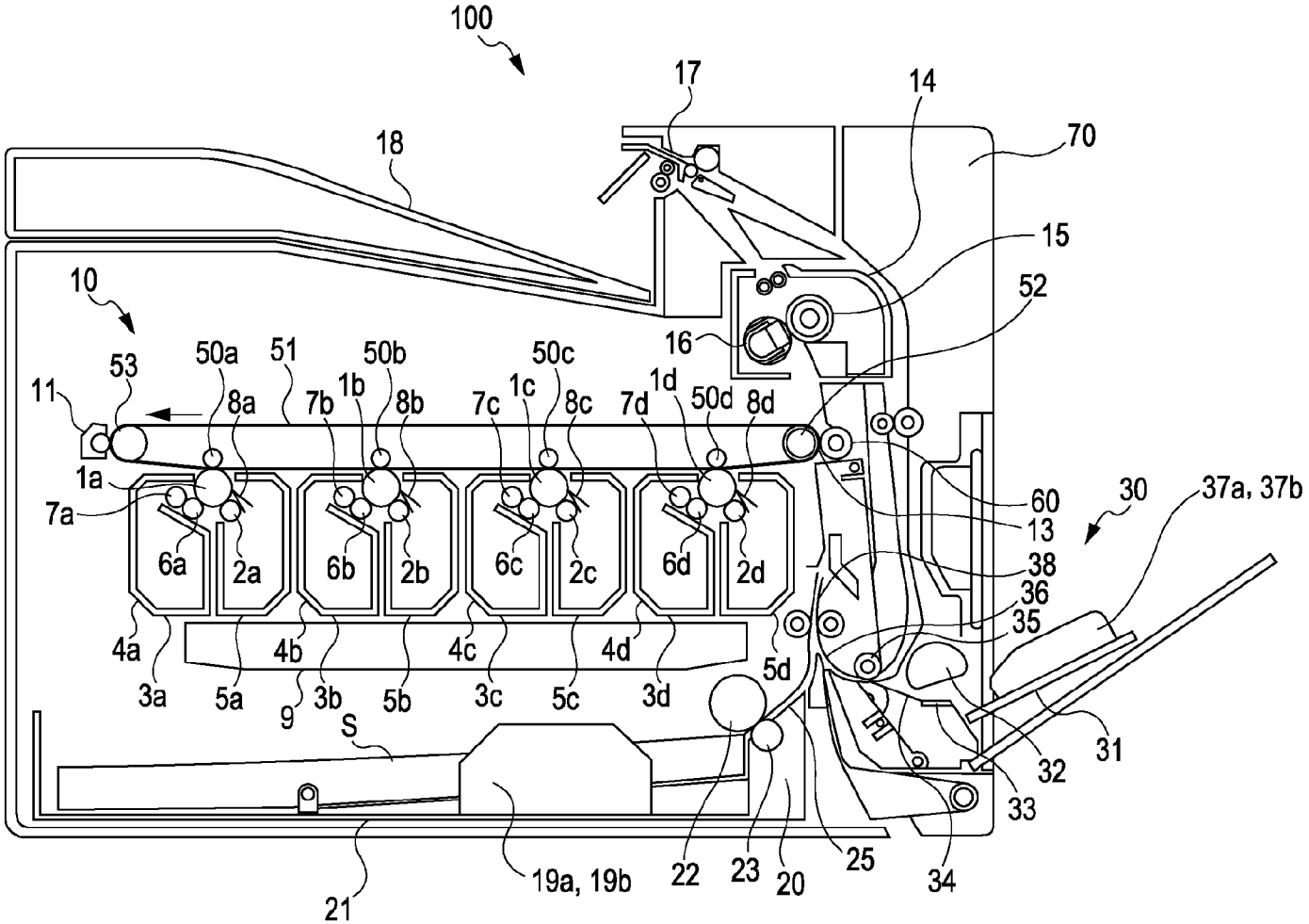
FIG. 1 shows the outline of an image forming apparatus according to the present invention.

First, the overall configuration of an image forming apparatus will be outlined with reference to FIG. 1. The image forming apparatus according to the embodiment is a color laser printer (hereinafter referred to as main body) 100 that is a main body of an image forming apparatus. FIG. 1 is a vertical sectional view showing the overall configuration thereof.

(1) Image Forming Process Section

The main body 100 shown in FIG. 1 has process cartridges 3*a*, 3*b*, 3*c*, and 3*d* that are detachable from the main body 100. These four process cartridges 3*a*, 3*b*, 3*c*, and 3*d* have the same structure but differ from each other in that they contain different colors of toner, that is, yellow (Y), magenta (M), cyan (C), and black (Bk) toner as developer. The process cartridges 3*a*, 3*b*, 3*c*, and 3*d* include developing units 4*a*, 4*b*, 4*c*, and 4*d*, respectively, and cleaner units 5*a*, 5*b*, 5*c*, and 5*d*, respectively.

The developing units 4*a*, 4*b*, 4*c*, and 4*d* have developing rollers 6*a*, 6*b*, 6*c*, and 6*d*, respectively, for developing latent images on photosensitive drums, and developer applying rollers 7*a*, 7*b*, 7*c*, and 7*d*, respectively, and toner containers that contain toner. The cleaner units 5*a*, 5*b*, 5*c*, and 5*d* have photosensitive drums 1*a*, 1*b*, 1*c*, and 1*d*, respectively, that are image bearing members, charging rollers 2*a*, 2*b*, 2*c*, and 2*d*, respectively, that uniformly charge the photosensitive drums, cleaning blades 8*a*, 8*b*, 8*c*, and 8*d*, respectively, serving as cleaners that clean the photosensitive drums, and waste toner containers.

Under the process cartridges 3*a*, 3*b*, 3*c*, and 3*d*, a scanner unit 9 is disposed, and it exposes the photosensitive drums 1*a*, 1*b*, 1*c*, and 1*d* on the basis of an image signal. The photosensitive drums 1*a*, 1*b*, 1*c*, and 1*d* are charged by the charging rollers 2*a*, 2*b*, 2*c*, and 2*d*, respectively, to a predetermined negative potential, and then electrostatic latent images are formed on the respective photosensitive drums by the scanner unit 9. These electrostatic latent images are reverse-developed by the developing units 4*a*, 4*b*, 4*c*, and 4*d* and toner with negative polarity is attached thereto. Thus, Y, M, C, and Bk toner images are formed.

The process cartridges 3*a*, 3*b*, 3*c*, and 3*d* and the scanner unit 9 constitute an image forming section for forming images (visible images). Images formed in the image forming section are primarily transferred to an intermediate transfer belt 51 described below.

In an intermediate transfer belt unit 10, an intermediate transfer belt 51 is looped over a driving roller 52 and a tension roller 53, the tension roller 53 applying tensile force to the intermediate transfer belt 51 in the direction of the arrow. Opposite the respective photosensitive drums 1*a*, 1*b*, 1*c*, and 1*d* and inside the intermediate transfer belt 51 are provided primary transfer rollers 50*a*, 50*b*, 50*c*, and 50*d*, to which a transfer voltage (also referred to as transfer bias) is applied by a voltage applying unit (not shown).

Each photosensitive drum rotates clockwise in FIG. 1, the intermediate transfer belt 51 rotates counterclockwise, and a positive bias is applied to the primary transfer rollers 50*a*, 50*b*, 50*c*, and 50*d*. Thereby, the toner images formed on the photosensitive drums 1*a*, 1*b*, 1*c*, and 1*d* are primarily transferred to the intermediate transfer belt 51 in order from the toner image on the photosensitive drum 1*a*. Primarily transferred, four colors of toner images are conveyed in a superimposed state to a secondary transfer section (secondary transfer position) 13.

After the transfer of toner images, a small amount of toner remaining on the surfaces of the photosensitive drums 1*a*, 1*b*, 1*c*, and 1*d* is removed by the cleaning blades 8*a*, 8*b*, 8*c*, and 8*d*, respectively. Toner remaining on the intermediate transfer belt 51 after the secondary transfer of toner images to a sheet S serving as a recording medium is removed by a transfer belt cleaning device 11. The removed toner is recovered as waste toner into a waste toner recovery container (not shown).

(2) Sheet Feed Sections

The image forming apparatus of this embodiment has two sheet feed sections. A first sheet feed section is a main body sheet feed section 20 provided in the inside of the main body 100. A second sheet feed section is a manual sheet feed section 30 provided in the side of the main body 100.

The main body sheet feed portion 20 includes a paper cassette 21 and side restriction plates 19*a* and 19*b*. The paper cassette 21 is inserted so as to abut a positioning portion of the main body of the image forming apparatus. In this embodiment, the paper cassette 21 abuts a front plate (not shown) provided in the front of FIG. 1. The positioning of sheets in the paper cassette 21 in a direction perpendicular to the sheet conveying direction (the width direction of sheets) is performed by the side restriction plates 19*a* and 19*b*. These side restriction plates are attached to the paper cassette 21 so as to be able to move to fit the width of sheets. The side restriction plate 19*a* is the restriction plate in the front of FIG. 1. The side restriction plate 19*b* is the restriction plate in the back of FIG. 1. Thanks to these side restriction plates, a stack of sheets S is loaded with only the upper side thereof open and in a positioned state, and is highly accurately positioned with respect to the main body of the image forming apparatus.

The main body sheet feed section 20 further includes a paper feed roller 22 that feeds sheets S out of the paper cassette 21 containing sheets S, and a separation roller 23 for separating fed sheets. The sheets S contained in the paper cassette 21 are pressed against the paper feed roller 22, and are separated one at a time by the separation roller 23 and conveyed. The separated sheet S is conveyed through a main body paper feed path 25 to a registration roller pair 38 that constitutes a conveying unit.

The manual sheet feed section 30 has a middle plate 31 on which sheets S are loaded, a paper feed roller 32 that feeds the uppermost sheet S on the middle plate 31, and a separation pad 33 for separating sheets. The manual sheet feed section 30 further has side restriction plates 37*a* and 37*b* that restrict the position of sheets S in a direction perpendicular to the sheet conveying direction (the width direction of sheets S). The side restriction plate 37*a* is the restriction plate in the front of FIG. 1. The side restriction plate 37*b* is the restriction plate in the back of FIG. 1. When sheets S are fed, the middle plate 31 rises, and sheets S loaded on the middle plate 31 are pressed against the paper feed roller 32, separated one at a time by the separation pad 33, and conveyed. The separated sheet S is conveyed through a manual paper feed path 34 to a refeeding roller pair 35, and is then conveyed through a refeeding path 36 to the registration roller pair 38.

As described above, two conveying paths of the main body paper feed path 25 and the manual paper feed path 34 merge on the upstream side of the registration roller pair 38 of the main body 100.

(3) Secondary Transfer Section

The sheet S is conveyed by the registration roller pair 38 to a secondary transfer section 13. In the secondary transfer section 13, by applying a positive bias to a secondary transfer roller 60, the four colors of toner images on the intermediate transfer belt 51 are secondarily transferred to the conveyed sheet S. The four colors of toner images on the intermediate transfer belt 51 are superimposed and form a color image.

(4) Fixing Section

Reference numeral 16 denotes a fixing member serving as a heating member, and reference numeral 15 denotes an elastic pressing roller serving as a pressing member. The fixing member 16 and the pressing roller 15 are pressed against each other, thereby forming a fixing nip serving as a heating nip. The sheet S that bears an unfixed toner image is conveyed to the fixing nip and passes through the fixing nip, and thereby the unfixed toner image is heated and fixed. After passing through the fixing nip, the sheet S is ejected onto an output tray 18 by an ejecting roller 17 provided in a paper ejecting section.

(5) Paper Ejecting Section

After passing through the fixing nip, the sheet S to which the toner image is fixed is ejected onto the output tray 18 by the ejecting roller 17 of the paper ejecting section.

(6) Intermediate Transfer Section

Figure 2:
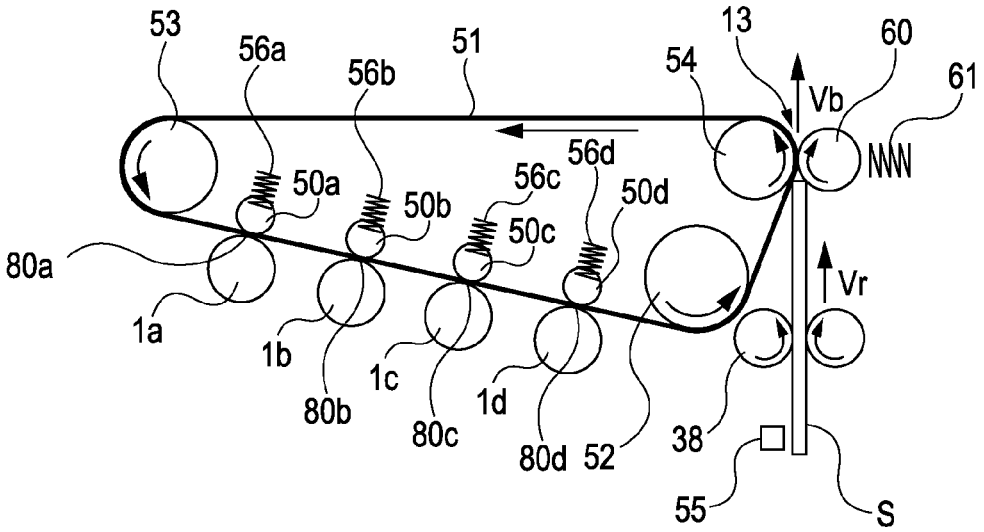
FIG. 2 shows the outline of an intermediate transfer section according to the present invention.

FIG. 2 shows the configuration of an intermediate transfer section of the image forming apparatus in this embodiment. In this embodiment, an intermediate transfer belt unit is used as an intermediate transfer section. The intermediate transfer belt unit includes a driving roller 52, a tension roller 53, a secondary transfer opposite roller 54, primary transfer rollers 50*a*, 50*b*, 50*c*, and 50*d*, and an intermediate transfer belt 51. The intermediate transfer belt 51 is supported by the driving roller 52, the tension roller 53, and the secondary transfer opposite roller 54. The primary transfer rollers 50*a*, 50*b*, 50*c*, and 50*d* are pressed against the photosensitive drums 1*a*, 1*b*, 1*c*, and 1*d*, respectively, by compression springs 56*a*, 56*b*, 56*c*, and 56*d*, respectively, at a predetermined contact pressure. The contact portions of the primary transfer rollers 50*a*, 50*b*, 50*c*, and 50*d* form primary transfer nips 80*a*, 80*b*, 80*c*, and 80*d*, respectively (hereinafter referred to as T1 nips). The secondary transfer roller 60 is pressed against the intermediate transfer belt 51 (and the secondary transfer opposite roller 54) by a compression spring 61 at a predetermined contact pressure and forms a secondary transfer section 13 (hereinafter referred to as T2 nip).

(7) Example of Sheet Conveying Operation and Sheet Velocity Control

Next, a description will be given of a sheet conveying operation leading up to the entry of a sheet S into the T2 nip 13 in this embodiment.

A sheet S fed from the sheet feed section 20 or 30 pauses at the registration roller pair 38. This pausing at the registration roller pair 38 is for synchronizing the sheet S with toner images formed on the intermediate transfer belt 51 and transferring the toner images to a predetermined position on the sheet S. During pausing, the thickness of the sheet S is detected by a thickness detection sensor 55. After that, the sheet S is conveyed to the T2 nip, and the toner images primarily transferred to the intermediate transfer belt 51 from the photosensitive drums 1*a* to 1*d* in the T1 nips 80*a* to 80*d* are transferred to the sheet S. A light-transmission thickness detection sensor having a light emitter and a light detector that detects light through a sheet S, can be used as the thickness detection sensor 55. Not only the light transmission method but also any other detection method can be applied to the thickness detection sensor 55.

In this embodiment, the velocity of the registration roller pair 38 is denoted by Vr, and the velocity of the intermediate transfer belt 51 in the T2 nip 13 is denoted by Vb. The velocity Vr of the registration roller pair 38 in this embodiment means the velocity in the nip formed by the registration roller pair 38. The velocity Vb of the intermediate transfer belt 51 is an image forming velocity at which the toner images primarily transferred to the intermediate transfer belt are secondarily transferred to the sheet S. This image forming velocity can be variably set according to the thickness of the sheet S. For example, if the image forming velocity in secondary transfer onto plain paper is 1, the image forming velocity is set to ½ in the case of heavy paper thicker than plain paper. In the case of heavy paper, transfer efficiency and fixability are low compared to the case of plain paper. Therefore, in the case of heavy paper, the image forming velocity is reduced for stable transfer and fixing.

In the case where the sheet S is of heavy paper, in the process of being conveyed by the registration roller pair 38 and entering the T2 nip 13, the sheet S compresses the compression spring 61 by the thickness of the sheet S. At the time of this entry of the sheet S, the drive load of the intermediate transfer belt 51 increases. This variation in drive load causes deformation in drive transmission members, such as gears, that drive the driving roller 52, a delay in drive transmission, and a temporary decrease in the velocity of the intermediate transfer belt 51. This temporary decrease in the velocity of the intermediate transfer belt 51 relative to the photosensitive drums 1*a* to 1*d* partly increases the density of toner images being transferred in the T1 nips 80*a* to 80*d* and results in a defective image (density variation in an image).

The reason why the transfer is susceptible to the decrease or variation in velocity will be explained. In the configuration of FIG. 2 of this embodiment, the photosensitive drums 1*a*, 1*b*, 1*c*, and 1*d* are pressed against the part of the intermediate transfer belt 51 between the driving roller 52 and the tension roller 53. When the intermediate transfer belt 51 is driven, the part of the intermediate transfer belt 51 between the driving roller 52 and the tension roller 53 is maintained in a tense state by the driving force of the driving roller 52 and the tensile force of the tension roller 53. In the part of the intermediate transfer belt 51 in such a tense state, the transfer is susceptible to the above-described decrease or variation in velocity.

Another reason why the transfer is susceptible to the velocity variation is that the contact pressure of the secondary transfer roller 60 to the secondary transfer opposite roller 54 in the T2 nip 13 is set high. When a sheet S is conveyed at a higher velocity and secondary transfer is performed thereto, the efficiency of secondary transfer tends to decrease with an increase of the velocity at which the sheet S is conveyed. To curb the decrease in transfer efficiency, the contact pressure in the T2 nip 13 is increased. In the case where the contact pressure in the T2 nip 13 is high, the velocity of the intermediate transfer belt 51 significantly varies when the sheet S enters the T2 nip 13 compared to the case where the contact pressure is low.

Figure 3:
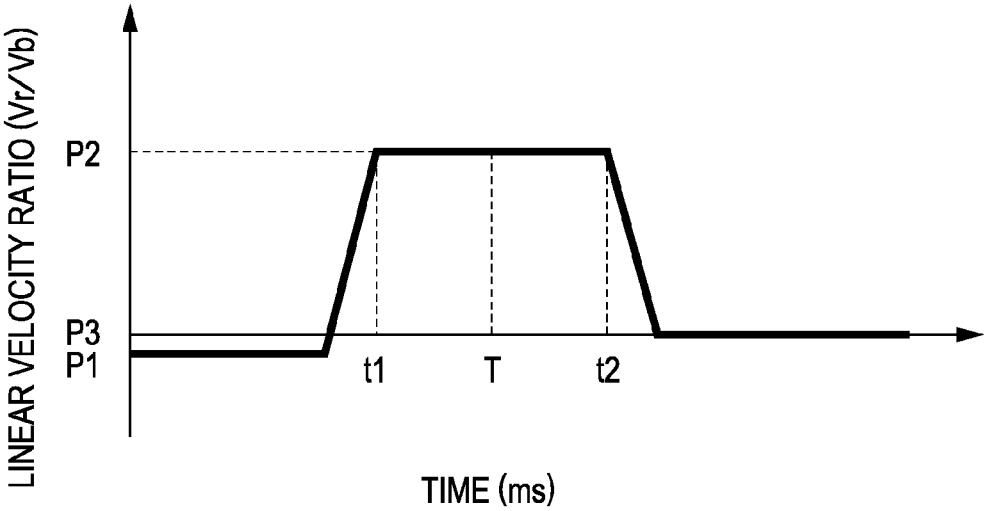
FIG. 3 is a graph showing the velocity control of a registration roller pair according to a first embodiment of the present invention.

In this embodiment, to curb the decrease in belt velocity, the velocity of the sheet S is controlled as shown in FIG. 3.

In the graph of FIG. 3, the horizontal axis shows the time (unit: ms) that has elapsed since the resuming of the conveyance of the sheet S after the pause at the registration roller pair 38, and the vertical axis shows the velocity ratio (Vr/Vb) between the velocity Vr of the registration roller pair 38 and the velocity Vb of the intermediate transfer belt 51. The velocity Vb of the intermediate transfer belt 51 is constant and determined by the thickness of the sheet S. Specifically, if the velocity in the case where the sheet S is plain paper is 1, Vb in the case of heavy paper is set, for example, to ¼ or ⅓.

The time when the leading edge of the sheet S enters the T2 nip 13 is denoted by T. Before the time t1, the sheet S is conveyed at a velocity ratio P1. Between the time t1 and the time t2, the sheet S is conveyed at a velocity ratio P2. After the time t2, the velocity ratio is changed to P3. That is, the velocity ratio is changed twice before and after the leading edge of the sheet S enters the T2 nip 13. However, $t1<T<t2$ is satisfied.

At the moment the leading edge of the sheet S enters the T2 nip 13, the velocity Vr of the registration roller pair 38 needs to be constant. The reason is that if the sheet S enters the T2 nip 13 at nonconstant velocity (in an accelerated state), load variation occurs in the middle of changing the speed of the motor, the speed of the motor becomes unstable, and a step-out of the motor can occur.

The time when the sheet S enters the T2 nip 13 can vary, for example, due to the slippage of the registration roller pair 38. Therefore, in consideration of the variation in time, the times t1 and t2 are determined so that the velocity Vr of the registration roller pair 38 when the leading edge of the sheet S enters the T2 nip 13 is constant. The time interval between t1 and T and the time interval between T and t2 are predetermined time intervals and values experimentally determined by the velocity Vb of the intermediate transfer belt 51 and the velocity Vr of the registration roller pair 38.

Next, the velocity ratios P1, P2, and P3 will be described. When the velocity ratio P1 is applied, the sheet S is yet to enter the T2 nip 13 and is not yet in contact with the intermediate transfer belt 51. Therefore, the value of P1 is determined, for example, so that the movement of the toner images on the intermediate transfer belt 51 can be synchronized with the movement of the sheet S.

The determination of the value of P2 is very important for curbing the velocity variation of the intermediate transfer belt 51 when the leading edge of the sheet S enters the T2 nip 13.

With an increase in the value of P2 or with an increase in the thickness and elasticity of the sheet S, the force of the sheet S that assists the rotation of the intermediate transfer belt 51 increases, and therefore the curbing effect on the decrease in the velocity of the intermediate transfer belt 51 increases. However, if the value of P2 is too large, the force that assists the rotation of the intermediate transfer belt 51 becomes too large, and the velocity of the intermediate transfer belt 51 can increase.

In this embodiment, basis weight is used as a parameter showing the thickness of the sheet S. In this embodiment, if this basis weight is smaller than 160 g/m$^2$, the velocity variation of the intermediate transfer belt 51 when the sheet S enters the T2 nip 13 is small, and therefore P2 is set to 1. In the case of so-called gloss paper or heavy paper having a basis weight in the range of 160 to 220 g/m$^2$, the velocity variation of the intermediate transfer belt 51 when the sheet S enters the T2 nip 13 is large, and therefore P2 is set in the range of $1.07<P2<1.15$. This range is the optimum range for the configuration shown in this embodiment. If the configuration of the apparatus, for example, the length or material of the intermediate transfer belt 51, is changed, the optimum range for the changed configuration is determined.

The velocity ratio P3 is applied in the process of transferring the toner images on the intermediate transfer belt 51 onto the sheet S. Therefore, it is preferable to set the value of P3 to 1 or a value close to 1, which is a value smaller than the above minimum value of P2, 1.07. That is, the velocity of the registration roller pair 38 is changed so as to correspond to the velocity of the intermediate transfer belt 51.

In addition, in this embodiment, the velocity ratio is changed to P3 while the leading edge margin (about 2 to 5 mm) of the sheet S is passing through the T2 nip 13. That is, the change from P2 to P3 is performed before the printing area of the sheet S enters the T2 nip 13. Thus, the process of transferring the toner images on the intermediate transfer belt 51 onto the sheet S is not affected.

It is experimentally confirmed that even if the condition where the velocity ratio is P2 extends to the process of transferring the toner images on the intermediate transfer belt 51 onto the sheet S, the images are not affected as long as $P2<1.15$.

If the registration roller pair 38 is worn away and the diameters thereof decrease, P2 decreases, and therefore the curbing effect on the velocity variation of the intermediate transfer belt 51 decreases. In that case, according to the degree of wear, the speed of the motor that drives the registration roller pair 38 is adjusted so that P2 falls in the range of $1.07<P2<1.15$.

Similarly, due to the environmental variation, the roller diameters of the driving roller 52 and the registration roller pair 38 slightly vary. Therefore, for example, a temperature detection sensor (not shown) is provided in the image forming apparatus. According to the temperature detected by the temperature detection sensor, the speed of the motor that drives the registration roller pair 38 is adjusted so that P2 falls in the range of $1.07<P2<1.15$.

Figure 7:
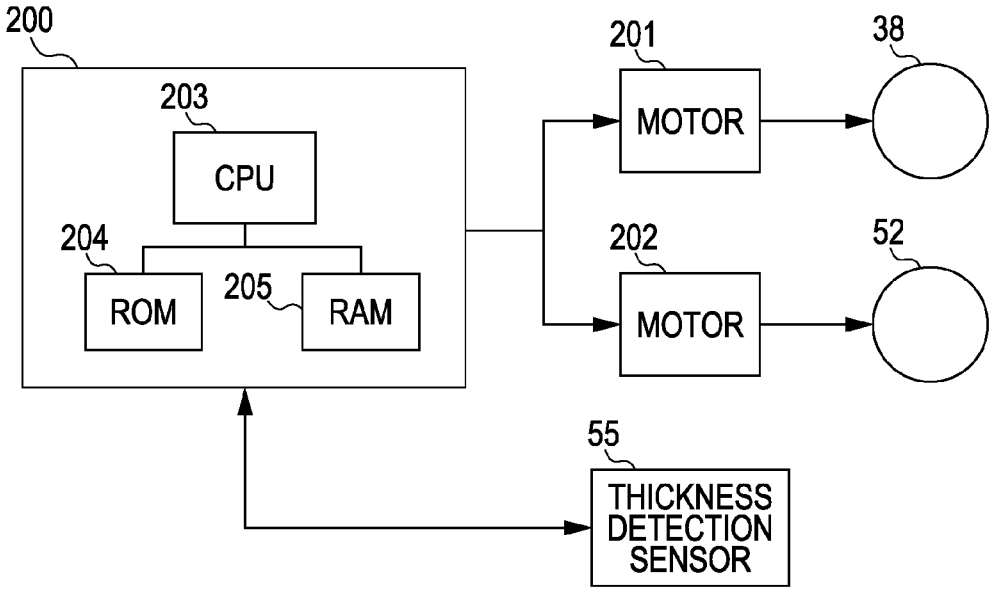
FIG. 7 is a block diagram according to the present invention.

The above-described velocity control is performed, for example, according to an instruction signal from a controller provided in the main body of the image forming apparatus as shown in FIG. 7. Specifically, a controller 200 that controls the operation of the image forming apparatus controls the driving of a motor 201 for controlling the rotation of the registration roller pair 38 and a motor 202 for controlling the rotation of the driving roller 52 that rotationally drives the intermediate transfer belt 51. The controller 200 also controls the detection operation of the thickness detection sensor 55. When the leading edge of the sheet S reach the registration roller pair 38, the controller 200 instructs the thickness detection sensor 55 to operate and obtains the detection result of the thickness detection sensor 55. The controller 200 has a CPU 203 serving as a control unit, and a ROM 204 and a RAM 205 serving as storage units. The CPU 203 of the controller 200 reads out a program for control stored in the ROM 204 and data stored in the RAM 205 and executes the above-described control.

Figure 4:
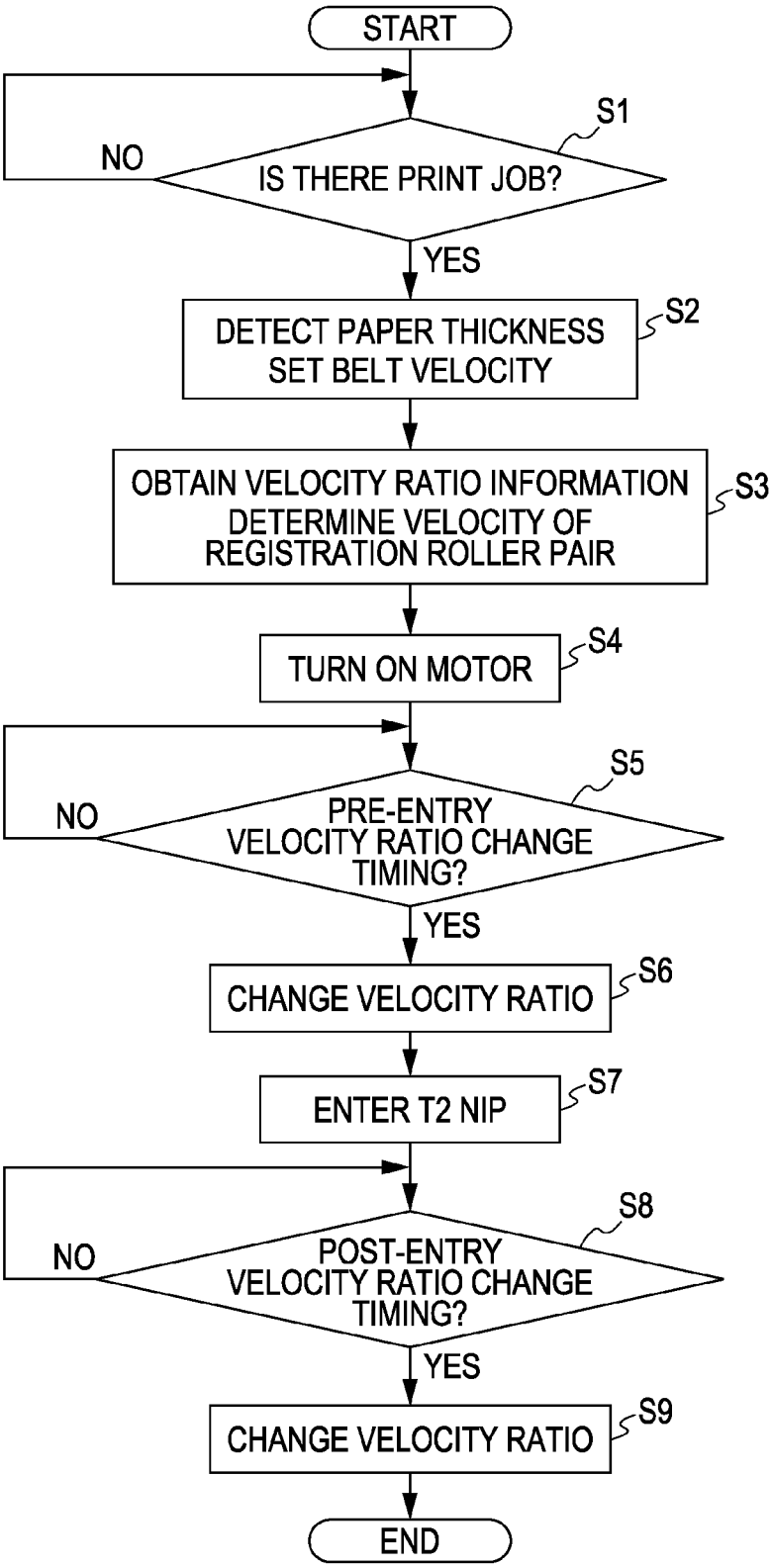
FIG. 4 is a flow chart of the velocity control of a registration roller pair according to a first embodiment of the present invention.

Next, the flow of the above-described velocity control of the registration roller pair 38 will be described with reference to the flow chart of FIG. 4.

After it is determined that there is a print job (step S1), a sheet S is fed. The sheet S pauses when its leading edge reaches the registration roller pair 38.

Then, the thickness of the sheet S is detected by the thickness detection sensor 55, and the velocity of the intermediate transfer belt 51 is set according to the detected thickness of the sheet S (step S2). The velocity ratio P2 may be variably set according to the detected thickness of the sheet S. In this embodiment, P2 can be variably set, for example, in the above range of $1.07<P2<1.15$ according to the thickness of the sheet S.

After that, the information of the above velocity ratio stored in the RAM 204 in the controller 200 is read out, and the velocity of the registration roller pair 38 is determined (step S3).

To start the rotation of the registration roller pair 38 to resume the conveyance of the sheet S, the motor 201 is turned on (step S4).

After the motor 201 is turned on, and when the timing of velocity ratio change before the entry of the sheet S into the T2 nip 13 comes (step S5), the velocity ratio is changed (step S6). (In this embodiment, the velocity ratio is set to P2.) After the velocity ratio is changed, the leading edge of the sheet S enters the T2 nip 13 (step S7). After that, when the timing of velocity ratio change after the entry of the sheet S into the T2 nip 13 comes (step S8), the velocity ratio is changed (set to P3 in this embodiment) and the control is ended (step P9).

As described above, in this embodiment, when the sheet S is thick, the velocity ratio between the registration roller pair 38 and the intermediate transfer belt 51 is changed from P1 to P2 before the sheet S enters the T2 nip 13. That is, when the sheet S enters the T2 nip 13, the velocity of the registration roller pair 38 is higher than the velocity of the intermediate transfer belt 51 (and constant). By controlling in this way, the decrease in the velocity of the intermediate transfer belt 51 when the sheet S enters the T2 nip 13 can be curbed, and defective image formation can be prevented from occurring.

In this embodiment, the thickness of the sheet S is detected using the thickness detection sensor 55. Instead, the control of this embodiment can be executed according to the type of the sheet S set by a user, for example, via an operation panel (not shown) provided in the image forming apparatus. The control of this embodiment can also be executed in response to the information (command) from a computer connected to the image forming apparatus and according to the specified type of the sheet S.

Second Embodiment

This embodiment differs from the first embodiment in that the velocity ratio after the entry of the sheet S into the T2 nip 13 is changed from P2 to P4 ($P4<1$) and is then returned to P3. Except for this point, this embodiment is the same as the first embodiment, so the redundant description will be omitted.

Figure 5:
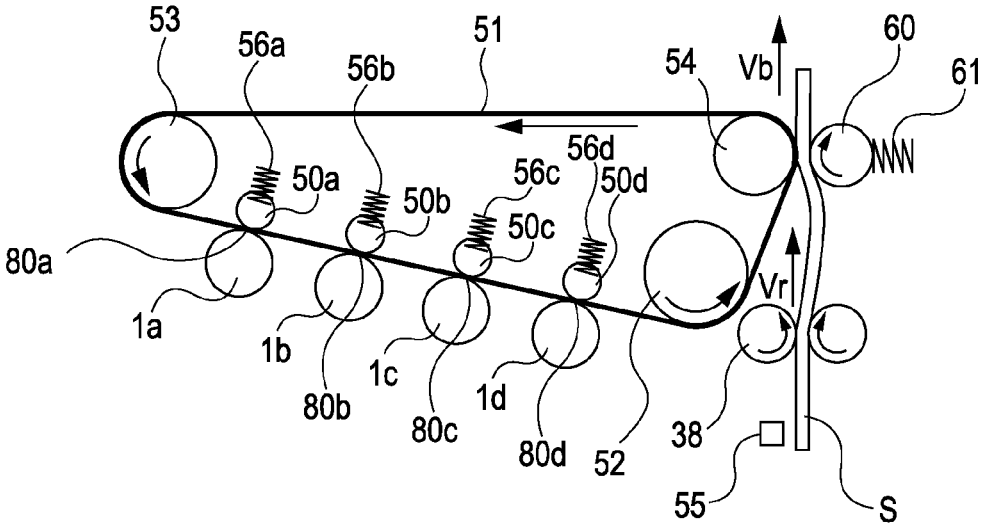
FIG. 5 shows the state of a sheet in an intermediate transfer section according to a second embodiment of the present invention.

The necessity of the velocity control of this embodiment will be explained. During the time between the entry of the sheet S into the T2 nip 13 and the change of the velocity ratio from P2 to P3 (between T and t2), the velocity Vr of the registration roller pair 38 is higher than the velocity Vb of the intermediate transfer belt 51 in the T2 nip 13 when $P2>1$. Therefore, a curve such as that shown in FIG. 5 can be formed between the registration roller pair 38 and the T2 nip 13. The formation of this curve is likely to occur when a sheet of particularly elastic heavy paper enters the T2 nip 13. When P3 is 1 or close to 1, this curve can persist until the trailing edge of the sheet S has passed through the registration roller pair 38.

In the case of a sheet S of particularly elastic heavy paper, the velocity variation of the intermediate transfer belt 51 when the sheet S enters the T2 nip 13 is significant, and therefore P2 needs to be increased to curb the velocity variation of the intermediate transfer belt 51. However, the degree of the curve can increase with an increase in P2. In the case of particularly elastic heavy paper, the elasticity of the curve can slightly increase the velocity of the intermediate transfer belt 51. Consequently, when, for example, a plurality of colors of toner images are superimposed to form a color image, color misregistration can occur.

Figure 6:
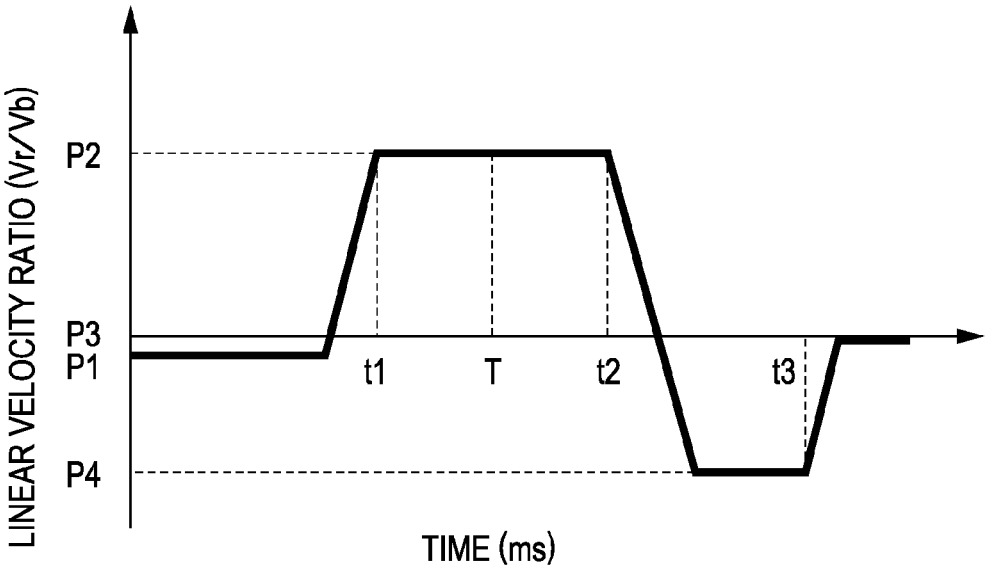
FIG. 6 is a graph showing the velocity control of a registration roller pair according to a second embodiment of the present invention.

To curb the velocity variation of the intermediate transfer belt 51 and to prevent defective image formation, such as color misregistration, from being caused by the elasticity of the sheet S even when particularly elastic heavy paper is used, the velocity control shown in FIG. 6 is performed in this embodiment.

The control before the time t2 is the same as the first embodiment (the same as FIG. 3). The difference is that the velocity ratio is reduced to P4 ($P4<1$) during the time between t2 and t3 and is then returned to P3 ($P3\approx1$).

This control is performed to eliminate the curve formed during the time between the entry of the sheet S into the T2 nip 13 and the change of the velocity ratio from P2 ($P2>1$) to P3 ($P3\approx1$) (the time between T and t2). To eliminate the formed loop, the velocity ratio is set to P4 ($P4<1$) during the time between t2 and t3. The degree of the curve is thereby reduced, and the sheet S can be prevented from being forced into the T2 nip 13 by the elasticity of the sheet S.

The velocity ratio P4 is determined by the degree of the curve formed. The value of P4 increases with an increase in the degree of the curve.

In the case where the sheet S is conveyed to the T2 nip 13 at high velocity, the elasticity of the sheet S that forces the sheet S into the T2 nip 13 has a significant effect on the velocity of the intermediate transfer belt 51. To increase the number of sheets S processed per unit time, the sheet conveyance velocity is increased. In an apparatus having increased sheet conveyance velocity, the elasticity of the sheet S that forces the sheet S into the T2 nip 13 has a significant effect on the velocity of the intermediate transfer belt 51, and therefore the control of this embodiment is necessary. In the case where the shape of the conveying path through which the sheet S is conveyed to the T2 nip 13 is prone to curve the sheet S, the control of this embodiment is effective. The control of this embodiment is also effective in the configuration described in the first embodiment in which the contact pressure between the secondary transfer roller and the secondary transfer opposite roller is set high.

As in the first embodiment, the velocity ratio is changed to P3 ($P3\approx1$) while the leading edge margin (about 2 to 5 mm) of the sheet S is passing through the T2 nip 13 so that the process of transferring the toner images on the intermediate transfer belt 51 to the sheet S is not affected. In this embodiment, the velocity ratio is changed while the leading edge margin of the sheet S is passing through the T2 nip 13. However, the change in the velocity ratio may be completed slightly after the leading edge margin of the sheet S has passed through the T2 nip 13 if the conveyance of the sheet S at the velocity ratio P4 has no effect on the images. Specifically, if the change in the velocity ratio is completed while the leading edge (about 1 mm) of the printing area of the sheet S is passing through the T2 nip 13, the images are little affected. The setting of the final velocity ratio P3 is the same as in the first embodiment, that is, the velocity of the registration roller pair 38 is changed so as to correspond to the velocity of the intermediate transfer belt 51.

As described above, in this embodiment, after the entry of the sheet S into the T2 nip 13, the velocity of the registration roller pair 38 is changed to a velocity (constant velocity) lower than the velocity of the intermediate transfer belt 51 and is then returned to a velocity about equal to the velocity of the intermediate transfer belt 51. Thus, even when particularly elastic heavy paper is used, the decrease in the velocity of the intermediate transfer belt 51 can be curbed, and color misregistration during image formation can be prevented.

The range of the value of the velocity ratio and the range of the leading edge margin in the first embodiment and the second embodiment are illustrative only. These values are appropriately set in consideration of the configuration of the apparatus, for example, the shape and length of the sheet conveying path, the materials of components such as the intermediate transfer belt 51 and the registration roller pair 38, and the sheet conveyance velocity.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. An image forming apparatus comprising:

an image bearing member;

an intermediate transfer member to which an image formed on the image bearing member is transferred;

a first transfer member configured to transfer the image formed on the image bearing member to the intermediate transfer member;

a second transfer member configured to transfer the image that was transferred on the intermediate transfer member to a recording medium and to come into contact with the intermediate transfer member to form a transfer nip portion;

a conveyance unit configured to convey the recording medium to the transfer nip portion; and a control unit configured to control a conveyance speed of the recording medium at the conveyance unit, wherein the control unit sets the conveyance speed at the conveyance unit as a first constant speed, faster than a moving speed of the intermediate transfer member, before a leading edge of the recording medium reaches the transfer nip portion, maintains the first constant speed until the leading edge of the recording medium reaches the transfer nip portion, and changes the conveyance speed at the conveyance unit from the first constant speed to a second speed which is not zero, lower than the first constant speed, after the leading edge of the recording medium reaches the transfer nip portion.

2. The image forming apparatus according to claim 1, wherein, before transferring of the image on the intermediate transfer member to the recording medium at the transfer nip portion is started, the control unit changes the conveyance speed at the conveyance unit from the first constant speed to the second speed.

3. The image forming apparatus according to claim 1, wherein the image is transferred from the image bearing member to the intermediate transfer member at the timing of when the leading edge of the recording medium reaches the transfer nip portion.

4. The image forming apparatus according to claim 1, wherein a range of a ratio of the first constant speed to the moving speed of the intermediate transfer member is 1.07 or more to 1.15 or less.

5. The image forming apparatus according to claim 1, wherein the second speed is lower than the moving speed of the intermediate transfer member.

6. The image forming apparatus according to claim 1, wherein the second speed is substantially equal to the moving speed of the intermediate transfer member.

7. An image forming apparatus comprising:

an image bearing member;

an intermediate transfer member to which an image formed on the image bearing member is transferred;

a first transfer member configured to transfer the image formed on the image bearing member to the intermediate transfer member;

a second transfer member configured to transfer the image that was transferred on the intermediate transfer member to a recording medium and to come into contact with the intermediate transfer member to form a transfer nip portion;

a conveyance unit, including a conveyance roller, configured to convey the recording medium to the transfer nip portion; and a control unit configured to control a peripheral speed of the conveyance roller, wherein the control unit sets the peripheral speed of the conveyance roller as a first constant speed, faster than a moving speed of the intermediate transfer member, before a leading edge of the recording medium reaches the transfer nip portion, maintains the first constant speed until the leading edge of the recording medium reaches the transfer nip portion, and changes the peripheral speed of the conveyance roller from the first constant speed to a second speed which is not zero, lower than the first constant speed, after the leading edge of the recording medium reaches the transfer nip portion.

8. The image forming apparatus according to claim 7, wherein, before transferring of the image on the intermediate transfer member to the recording medium at the transfer nip portion is started, the control unit changes the peripheral speed of the conveyance roller from the first constant speed to the second speed.

9. The image forming apparatus according to claim 7, wherein the image is transferred from the image bearing member to the intermediate transfer member at the timing of when the leading edge of the recording medium reaches the transfer nip portion.

10. The image forming apparatus according to claim 7, wherein a range of a ratio of the first constant speed to the moving speed of the intermediate transfer member is 1.07 or more to 1.15 or less.

11. The image forming apparatus according to claim 7, wherein the second speed is lower than the moving speed of the intermediate transfer member.

12. The image forming apparatus according to claim 7, wherein the second speed is substantially equal to the moving speed of the intermediate transfer member.

13. The image forming apparatus according to claim 7, wherein the intermediate transfer member is a cylindrical belt.

14. The image forming apparatus according to claim 13, further comprising a driving roller, contacting an inner surface of the cylindrical belt, for driving the cylindrical belt, wherein the first transfer member is provided at an upstream side on the cylindrical belt than a contact portion where the driving roller contacts the cylindrical belt in a moving direction of the cylindrical belt.

* * * * *